US005094024A

United States Patent [19]

Duke

[11] Patent Number: 5,094,024

[45] Date of Patent: Mar. 10, 1992

[54] MUZZLE LOADING CARTRIDGE

[76] Inventor: James A. Duke, 9901 Pendleton Pike, #5, Indianapolis, Ind. 46236

[21] Appl. No.: 702,955

[22] Filed: May 20, 1991

[51] Int. Cl.[5] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 243,250 | 6/1881 | Hall | 42/90 |
| 4,112,606 | 9/1978 | Griffin | 42/90 |
| 4,152,858 | 5/1979 | Dobbs | 42/90 |
| 4,207,698 | 6/1980 | Burson | 42/90 |
| 4,373,285 | 2/1983 | Grout et al. | 42/90 |
| 4,419,839 | 12/1983 | Wilson | 42/90 |
| 4,536,983 | 8/1985 | Fry | 42/90 |
| 4,550,517 | 11/1985 | Mansfield | 42/90 |
| 4,601,125 | 7/1986 | Curtis | 42/90 |
| 4,862,623 | 9/1989 | Delap et al. | 42/90 |
| 4,875,303 | 10/1989 | DeWeert et al. | 42/90 |

*Primary Examiner*—Charles T. Jordan

*Attorney, Agent, or Firm*—Woodard, Emhardt, Naughton, Moriarty & McNett

[57] ABSTRACT

A cartridge for use in loading a muzzle-loaded rifle comprises an outer cylinder in which is received a first, powder cylinder containing gunpowder and sealed at both ends, and a second, ball cylinder containing a ball and patch and sealed at both ends. An alignment cylinder is provided within which the outer cylinder may be received, and the alignment cylinder may then be fitted telescopically over the end of the rifle barrel to permit the ball, patch and powder to be pushed into barrel, simultaneously breaking the seals surrounding the powder.

21 Claims, 3 Drawing Sheets

MUZZLE LOADING CARTRIDGE

BACKGROUND OF THE INVENTION

1. Field of the Invention

The present invention relates to the field of apparatus for use in loading a muzzle-loading rifle, and more particularly to a device which provides a preloaded cartridge that is used to automatically dispense a desired amount of powder, along with a ball and patch, into the muzzle of a rifle.

2. Description of the Prior Art

For a muzzle-loading rifle, the manner of loading can significantly affect the performance of the rifle. In particular, the amount of powder used can cause a substantial variance in the firing of the rifle. When a rifle is being loaded outdoors, especially if speed is desired, the accuracy of measuring and dispensing powder into the muzzle will fluctuate. It is therefore desirable to have a device and method to make it possible to quickly and easily dispense a proper amount of powder into the muzzle.

Various systems have been proposed in the past to address this problem. In U.S. Pat. No. 4,875,303, issued to DeWeert et al. on Oct. 24, 1989, there is described a muzzleloading powder and projectile tool which comprises a body for containing the ball and powder. A plunger assembly having incremental graduations is secured to the body, and is used to force the ball and powder into the muzzle. However, the DeWeert et al. device does not provide a premeasured amount of powder, but requires the user to add the powder. Also, there is no internal sealing to separate the powder from the ball and patch.

A quick loading device for muzzle-loaded weapons is described in U.S. Pat. No. 4,862,623, issued to Delap et al. on Sept. 5, 1989. This device has a cylindrical body bored to the desired caliber and fitted with a removable sealing cap. Immediately above the lower end of the body is a rotatable valve mounted with the axis of rotation perpendicular to the bore, the valve having an internal opening of the same caliber and concentric with the bore in the body. When the valve is closed, a moisture resistant central cylindrical chamber is created above the valve and below the sealing cap. A premeasured quantity of powder is placed within this chamber and a patch and ball is positioned above the powder and beneath the sealing cap. The device is fitted to the barrel of a muzzle-loaded weapon and the valve rotated to drop the powder into the barrel. Removal of the sealing cap then allows the user to insert a ramrod directly through the device to seat the patched projectile within the barrel of the weapon.

A device for facilitating the loading of a muzzle loading firearm is described in U.S. Pat. No. 4,601,125, issued to Curtis on July 22, 1986. This device comprises a compact housing having inner and outer concentric hollow cylinders in it. The bottom ends of the cylinders are closed by a slide member which may be selectively moved to a position to open the bottom ends of both cylinders. With the bottom end closed, a measured charge of powder is poured into the outer cylinder. A ball with patch is placed in the inner cylinder. A removable cap, having a hole through it which is concentric with the upper opening of the inner cylinder, is placed over the housing to close off the top of the outer cylinder. A ramrod is inserted through the opening in the cap to extend into the inner cylinder and is depressed to place the ball above the movable slide loaded at the bottom. The device is subsequently placed over the end of the barrel of a gun, the slide member is moved to open the bottoms of the cylinders to permit the powder to drop into the barrel. The ramrod then is pushed downwardly to seat the ball in the barrel of the gun, rapidly loading it.

In U.S. Pat. No. 4,550,517, issued to Mansfield on Nov. 5, 1985, there is disclosed a quick-loading device which comprises a cylinder rotatably carried by a base, the cylinder having a plurality of elongated openings open all the way through. The base has an upper flat surface which mates with a lower flat surface of the cylinder, and an off-center opening adapted to be aligned with any one of the elongated openings. The base also has a side opening so that the end of the rifle barrel may be inserted for alignment with the off-center opening. The openings are each adapted to contain black powder, a patch and a ball. Indexing means control the revolution of the cylinder so that any one of the elongated openings may be axially aligned with the off-center opening in the base.

In U.S. Pat. No. 4,536,983, issued to Fry on Aug. 27, 1985, there is disclosed a reloading device which includes a plunger which is retracted while a ball is introduced into the chamber followed by a charge of gunpowder. A frangible membrane of paper or the like is placed over the open end of the chamber. A locking collar is brought into engagement with that portion of the membrane disposed around the sides of the chamber and the collar is forced upwardly to mount onto the chamber.

A muzzle loading device is also described in U.S. Pat. No. 4,152,858, issued to Dobbs on May 8, 1979. The device includes a tubular body defining a first bore extending longitudinally therethrough and having a diametrically enlarged counterbore opening outwardly of one end of the body. The interior of the body defines a shoulder at the inner end of the counterbore and a sleeve has one end thereof loosely and removably telescoped into the counterbore and defines a second bore extending therethrough of substantially the same diameter as the bore formed through the body. The second bore is of a diameter to snugly and slideably receive a ball of a predetermined size therein at least partially embraced within a patch. A thin, frangible and flexible disk of a larger plan area than the counterbore extends across the end of the sleeve telescoped into the counterbore and has its peripheral portions clamped between the outer surfaces of the sleeve and the opposing surfaces of the counterbore adjacent the inner end thereof.

In U.S. Pat. No. 4,373,285, issued to Grout et al. on Feb. 15, 1983, there is described a loading device which comprises an elongated attachment with a longitudinal bore across which is placed a frangible septum. The bore above the system is loaded with a measured powder charge and a projectile with wadding. The attachment is placed on the end of the muzzle of the gun, the septum is sundered by sundering means within the attachment, the powder passes by the sundered septum and the projectile is rammed into position by a ramrod inserted through the upper open end of the bore of said attachment.

As the foregoing list demonstrates, numerous devices have been proposed in the art to facilitate the loading of a muzzle-loaded rifle. Various approaches have been taken to provide a body that can be loaded with the powder, ball and patch, which are then forced from the container into the muzzle. However, the configuration of these devices makes it apparent that they are to be loaded by the end user. Also, none of these devices provides for a separation of the powder from the ball and patch, thus exposing the powder to contact with the moisture contained in the patch. This may be acceptible for a short period of time, but is not suited to extended shelf life for a preloaded unit.

The present invention provides a loading device which permits preloading a significant time prior to use, and which therefore is particularly adapted to be made and sold in a prepacked condition. This also permits the powder to be accurately measured by a manufacturer, relieving the end user of this process.

BRIEF SUMMARY OF THE INVENTION

Briefly describing one aspect of the present invention, there is provided a muzzle-loading cartridge which includes an outer cylinder within which are received in end-to-end relation a powder cylinder and a ball and patch cylinder. The powder cylinder includes seals at both ends, with gunpowder contained therebetween. The ball cylinder receives a ball and patch, and optionally may be sealed at one or both ends. An alignment cylinder can be fitted over the outer cylinder and then telescoped over the end of a rifle barrel to facilitate use of the cartridge to load a rifle.

It is an object of the present invention to provide a muzzle-loading cartridge to facilitate the loading of a ball, patch and powder into the end of a muzzle-loaded rifle.

A further object of the present invention is to provide a cartridge which include powder sealed from moisture either from the exterior or from the patch received in the adjacent ball cylinder.

Another object of the present invention is to provide a muzzle-loading cartridge which permits the preloading of the cartridge with precise amounts of gunpowder which may be so contained for extended periods of time.

It is a further object of the present invention to provide a muzzle-loading cartridge which makes it possible to load a rifle more quickly and accurately than otherwise possible.

Further objects and advantages of the present invention will be apparent from the description of the preferred embodiment which follows.

DESCRIPTION OF THE PREFERRED EMBODIMENT

Figure 1:
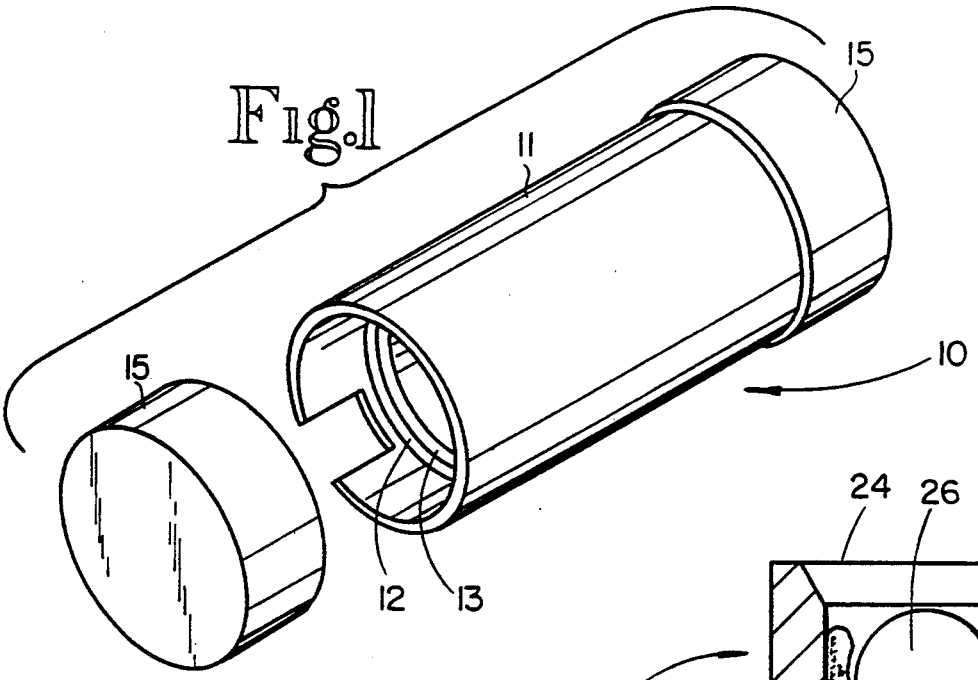
FIG. 1 is a perspective view of a muzzle-loading cartridge according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention provides a muzzle-loading cartridge which facilitates the quick and accurate loading of a rifle. The cartridge is designed to permit preloading of a precisely measured amount of gunpowder which is sealed therein against contact with moisture. A ball and patch may be provided and sealed therein, or may be separately added thereafter.

Referring in particular to the drawings, there is shown a cartridge 10 which comprises an alignment cylinder 11 in which are received an outer cylinder 12, and a powder cylinder 13 and ball cylinder 14 contained therein. As shown in FIG. 1, the cartridge may also include end caps 15 on either or both ends.

Figure 2:
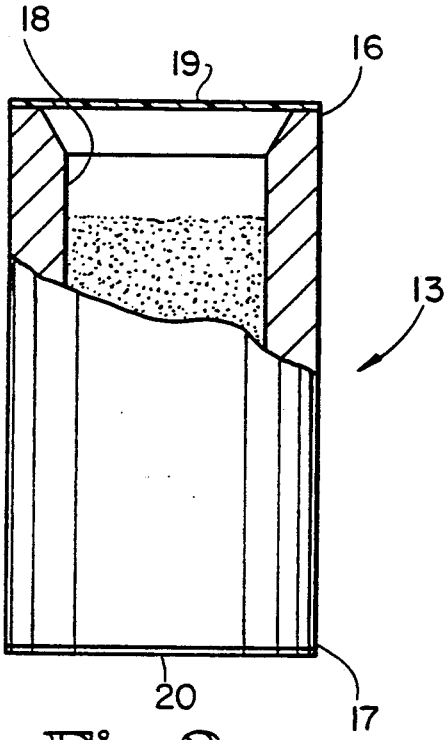
FIG. 2 is a side, partially cross-sectional view of a powder cylinder used in accordance with the present invention.

The cartridge includes a powder cylinder 13 (FIG. 2) which is generally cylindrical in nature and has a first end 16 and a second end 17. The powder cylinder 13 defines an inner bore 18 extending from the first end to the second end and further defines an outer diameter. The powder cylinder also includes a first powder seal 19 closing off the first end of the inner bore and a second powder seal 20 closing off the second end of the inner bore. The seals may be formed from a variety of materials, such as plastic, and are secured to the ends of the powder cylinder such as by gluing. The seals are preferably at least moisture resistant, and more preferably waterproof. Gunpowder is received within the bore of the powder cylinder 13. Also, a fill line 22 (FIG. 5) may be included to facilitate refilling of the powder cylinder.

Figure 3:
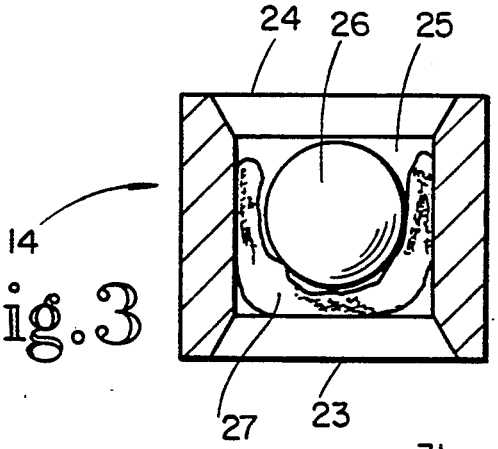
FIG. 3 is a side, cross-sectional view of a ball cylinder used with the present invention.

Also forming a part of the cartridge 10 is the ball cylinder 14 (FIG. 3) which includes a first end 23 and a second end 24, and an inner bore 25 extending therebetween. A ball 26 and patch 27 are receivable within the inner bore 25. As will be further described, seals 28 and 29 (FIG. 5) are preferably included to seal the first and second ends of the ball cylinder with the ball and patch received therebetween. For a prepacked cartridge in which the ball and patch are included therein, the seals are preferred to preserve the moisture contained in the patch. Alternatively, the ball cylinder could be filled by the ultimate user of the cartridge, thus providing his or her own ball and patch and diminishing the need to preserve the moisture in the patch grease.

Figure 4:
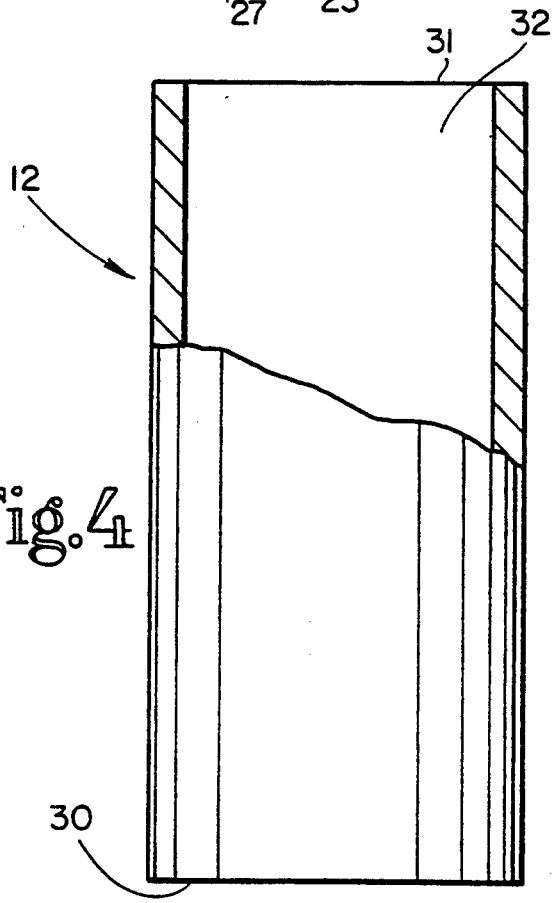
FIG. 4 is a side, partially cross-sectional view showing the outer cylinder used in the present invention.
Figure 5:
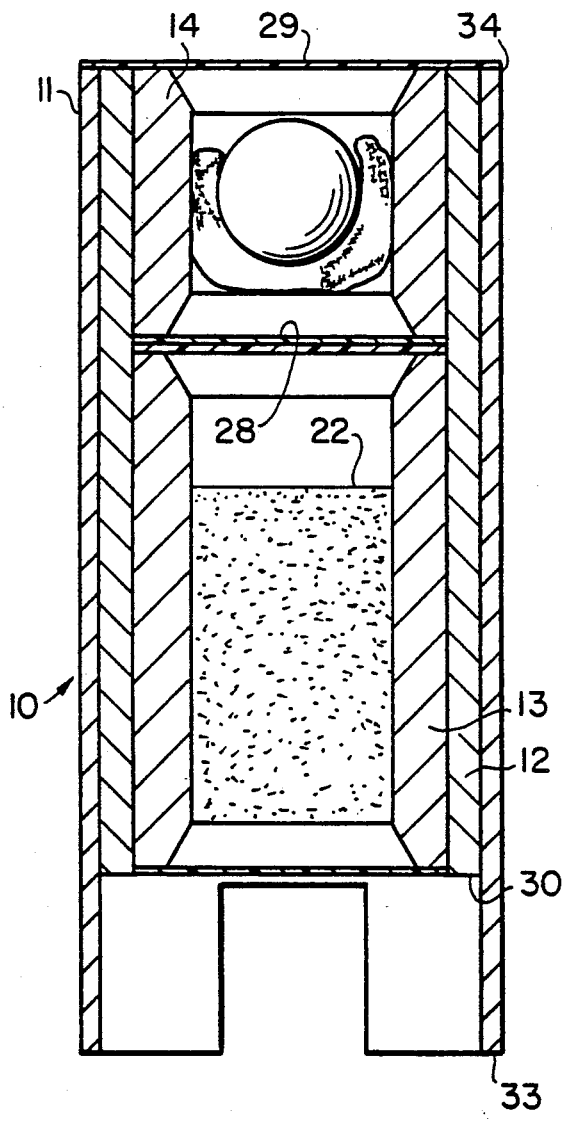
FIG. 5 is a side, cross-sectional view showing the muzzle-loading cartridge of FIG. 1.
Figure 6:
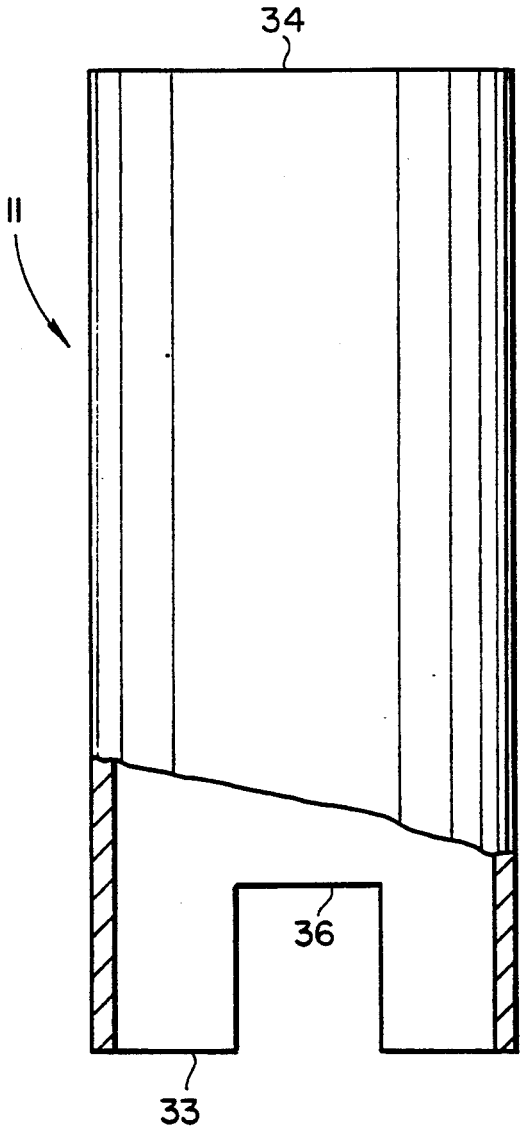
FIG. 6 is a side, partially cross-sectional view of an alignment cylinder useful with the present invention.

The powder and ball cylinders are received in an end-to-end relationship in an outer cylinder 12 (FIG. 4). This cylinder may be simply a cylindrical body having a first end 30 and a second end 31. The outer cylinder includes an internal diameter defining a central, longitudinal opening 32. As shown in FIG. 5, the powder cylinder is received within the longitudinal opening 32 of the outer cylinder 12 with its first end adjacent the first end of the outer cylinder. The ball cylinder is received also within the outer cylinder with its second end adjacent the second end of the outer cylinder. Preferably, the powder and ball cylinders are sized to be frictionally fit within the outer cylinder and to be positioned adjacent each other and extending fully from the first end of the outer cylinder to the second end of the outer cylinder. The powder and ball cylinders also preferably have internal bores which are sized the same as each other, and the same as the internal bore of the rifle barrel for which the loading cartridge is to be used.

Figure 7:
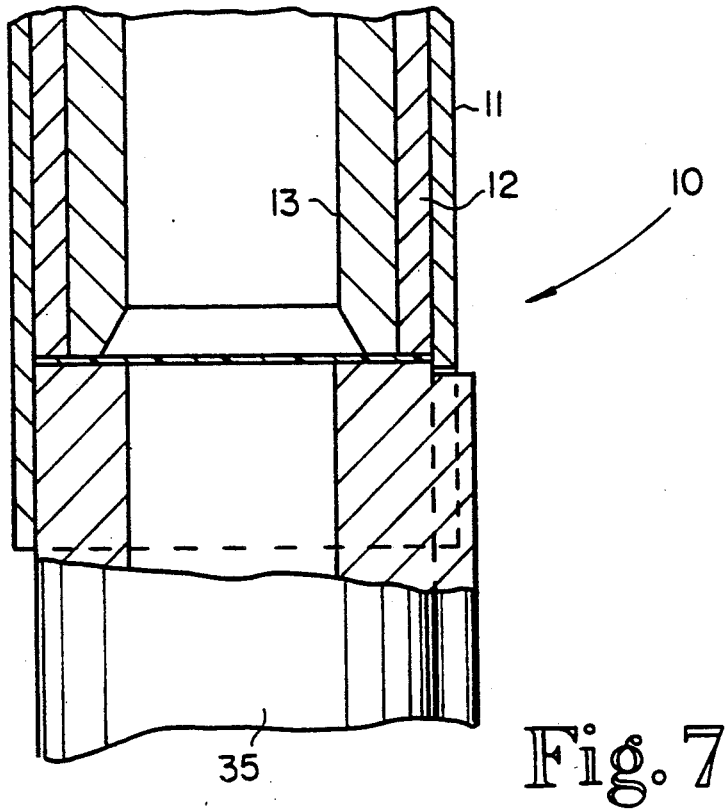
FIG. 7 is a side cross-sectional view showing the cartridge of FIG. 1 mounted to the end of a muzzle-loaded rifle.
Figure 8:
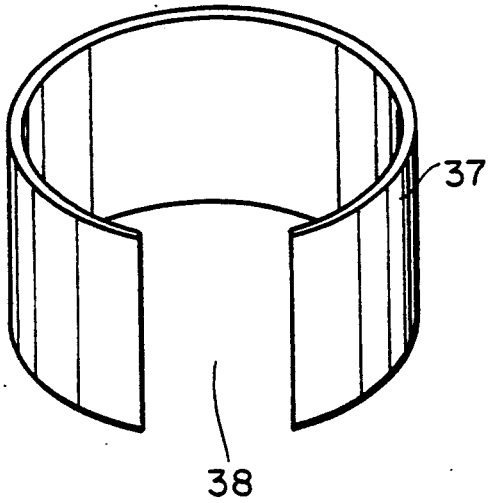
FIG. 8 is a perspective view of an adapter ring useful to facilitate mounting the alignment cylinder to a rifle barrel of reduced diameter.

Also as shown in FIG. 5, the outer cylinder 12 is received within the alignment cylinder 11, which may preferably be a press fit. The alignment cylinder is sized to be slightly longer than the outer cylinder, such that the first end 30 of the outer cylinder is spaced apart from the first end 33 of the alignment cylinder. At the same time, the second end of the outer cylinder is positioned adjacent the second end 34 of the alignment cylinder. The inner diameter of the alignment cylinder is sized to be received about the external diameter of a rifle barrel. In this manner, the cartridge can be readily mounted to the barrel 35 of a muzzle-loaded rifle in the manner shown in FIG. 7. The alignment cylinder is telescopically received about the barrel exterior. The alignment cylinder is also provided with a notch 36 within which the barrel rib of the rifle is received.

The cartridge 10 may be provided in a variety of sizes to match different rifle barrel exterior and interior diameters. The outer diameter of the outer cylinder is preferably sized the same as the outer diameter of the rifle barrel. In such case, the alignment cylinder will have an internal diameter closely fitting both the outer cylinder and the rifle barrel. Also, the internal bores of the powder and ball cylinders are preferably sized the same as each other and the same as the internal bore of the rifle barrel for which the cartridge is used. In this manner, the bores are positioned in aligned fashion when the ball, patch and powder are to be forced into the rifle barrel.

A manufacturer could reap substantial savings by sizing all outer cylinders with a diameter equal to the outside diameter of the largest diameter barrel contemplated. This would make all cartridge parts interchangeable, except for the powder and ball cylinders. Adapter rings are then used for smaller barrels. An adapter 37 may be provided which can be fitted into the first end of the alignment cylinder, with the gap 38 aligned with the notch 36. Thus, the internal diameter of the alignment cylinder, at the first end which is fitted over the rifle barrel, can be reduced in size by the insertion of one or more such adapters 37. The adapters may preferably be made of a resilient metal or plastic so that the adapter can be compressed for insertion into the first end of the alignment cylinder, which adapter would then spring back outwardly to be frictionally fit into the alignment cylinder.

When the cartridge 10 is used, the cartridge is first fit over the end of a muzzle-loaded rifle barrel. A ramrod is then used to force the ball, patch and powder into the barrel. The seals 19 and 20, and seals 28 and 29 if present, are formed of a material which will readily break upon application of pressure by such ramrod. All of the materials will then be forced into the rifle barrel. As shown particularly in FIGS. 2 and 3, the ends of the powder and ball cylinders may preferably be tapered inwardly. This will compensate for any misalignment of the interior bores of the powder and ball cylinders.

The cartridge may desirably be prepacked with the desired amounts and types of powder, ball and patch desired. As will be appreciated, a variety of such cartridges may be provided, with various configurations as to the types and amounts of materials contained in the powder and ball cylinders. Also, the cartridge makes it possible to have a manufacturer prefill particularly the powder cylinder with precise amounts of powder which will be protected from moisture by the end seals. The end caps 15 also provide further protection for the contents. These end caps may be of any suitable material, as may the cylinders themselves. The end caps are preferably secured with a safety mechanism, such as a pull tab as is commonly known, to ensure security for the cartridge before use and to facilitate removal of the end caps.

The cartridge of the present invention makes it possible to have a preloaded, waterproof system which greatly enhances the ability to load a muzzle-loaded rifle. As an example, the cartridge system can be used with 100% ffffg black powder. The cartridge may be provided with a premeasure of such powder suitable for use as a powerful and safe load for 0.45, 0.50, 0.54 and 0.58 caliber rifles. Because of the greater efficiency of this powder, top pressures are reached much faster, resulting in greatly increased velocity, energy and accuracy. Also, there is surer ignition, cleaner burning and use of over ⅓ less powder. This 4F powder is so powerful, that there has previously been a risk of blowing out the gun, and thus others have relied on 3F or 2F powder. However, the ability to preload accurate amounts of the 4F powder allows the use of such powder.

As a further example of the use of this invention, loads for the cartridge may include the following. For each, the preferred powder is available as FFFFg powder from GOEX, Inc., and the ball is available from Hornady or Speers. In each instance a 35% polyester, 65% cotton 0.011 patch is recommended. In conjunction with this invention, it has been discovered that these new loads enable the user to try only three different loads in order to find the best hunting load for his particular rifle. These loads, in succession, slightly increase the gas pressure behind the ball and patch, causing a slight increase of the diameter of the ball which makes a tighter fit of ball to rifle bore. The tightness of ball to bore needed for best accuracy varies from rifle to rifle. For a 0.45 caliber rifle, a 0.440 ball is used with loads (in grains) which range from 53 minimum to 59 maximum, with a middle load of 56. For a 0.50 caliber rifle, the parameters are a 0.490 ball, and loads of 69 to 75, with a middle load of 72. For a 0.54 caliber rifle, the preferred ball is a 0.535, and the three loads are 79, 82 and 85. For a 0.58 caliber, a 0.570 ball is recommended with loads of 89, 92 and 95.

With the present invention, the loading of a muzzle-loaded rifle is made much easier and faster. Preloaded cartridges may be obtained from a manufacturer, or may be prepared by the user. In either instance, the cartridge permits a significant shelf life for the load.

What I claim is:

1. A cartridge for use in loading a muzzle-loading rifle, the rifle having a barrel with a loading end defining an external diameter and a longitudinal bore, said cartridge comprising:

an outer cylinder having a first end and a second end and having an internal diameter defining a central, longitudinal opening;

a powder cylinder having a first end and a second end, said powder cylinder defining an inner bore extending from the first end to the second end and further defining an outer diameter sized to be received within the central opening of said first cylinder, said powder cylinder being received within said first cylinder with its first end adjacent the first end of said first cylinder, said powder cylinder including a first powder seal closing off the first end of the inner bore and a second powder seal closing off the second end of the inner bore;

gunpowder received within the inner bore of said powder cylinder and being contained therein by the first and second powder seals; and a ball cylinder having a first end and a second end, said ball cylinder defining an inner bore extending from the first end to the second end and further defining an outer diameter sized to be received within the central opening of said first cylinder, said ball cylinder being received within said first cylinder with its second end adjacent the second end of said first cylinder, the first end of said ball cylinder being adjacent the second end of said powder cylinder.

2. The cartridge of claim 1 and which further includes a ball and patch received within said ball cylinder between the first and second ends.

3. The cartridge of claim 2 in which said ball cylinder further includes a first ball seal closing off the first end of the inner bore and a second ball seal closing off the second end of the inner bore.

4. The cartridge of claim 1 in which the outer diameters of said powder and ball cylinders are sized to provide a friction fit when received within said outer cylinder.

5. The cartridge of claim 4 and which further includes a ball and patch received within said ball cylinder between the first and second ends.

6. The cartridge of claim 5 in which said ball cylinder further includes a first ball seal closing off the first end of the inner bore and a second ball seal closing off the second end of the inner bore.

7. The cartridge of claim 1 in which at least one of the first and second ends of at least one of said powder and ball cylinders is tapered inwardly.

8. The cartridge of claim 1 in which the inner bores of each of said powder and ball cylinders are sized the same as each other and the same as the longitudinal bore of the rifle.

9. The cartridge of claim 1 and which further includes an alignment cylinder defining a central opening having an internal diameter, said outer cylinder having an outer diameter sized the same as the external diameter of the rifle barrel, the internal diameter of said alignment cylinder being sized the same as the external diameter of the rifle barrel, said alignment cylinder being longer than said outer cylinder and having a first end and a second end, said outer cylinder being received within said alignment cylinder and having its first end spaced from the first end of said alignment cylinder and having its second end adjacent the second end of said alignment cylinder, whereby the first end of said alignment cylinder may be received telescopically over the end of the rifle barrel with the first end of said outer cylinder abutting the end of the barrel.

10. The cartridge of claim 9 and which further includes a ball and patch received within said ball cylinder between the first and second ends.

11. The cartridge of claim 10 in which said ball is a 0.440 ball and which includes from 53 to 59 grains of FFFFg gunpowder.

12. The cartridge of claim 10 in which said ball is a 0.490 ball and which includes from 69 to 75 grains of FFFFg gunpowder.

13. The cartridge of claim 10 in which said ball is a 0.535 ball and which includes from 79 to 85 grains of FFFFg gunpowder.

14. The cartridge of claim 10 in which said ball is a 0.570 ball and which includes from 89 to 95 grains of FFFFg gunpowder.

15. The cartridge of claim 10 in which said ball cylinder further includes a first ball seal closing off the first end of the inner bore and a second ball seal closing off the second end of the inner bore.

16. The cartridge of claim 9 in which the outer diameters of said powder and ball cylinders are sized to provide a friction fit when received within said outer cylinder.

17. The cartridge of claim 16 and which further includes a ball and patch received within said ball cylinder between the first and second ends.

18. The cartridge of claim 17 in which said ball cylinder further includes a first ball seal closing off the first end of the inner bore and a second ball seal closing off the second end of the inner bore.

19. The cartridge of claim 9 in which at least one of the first and second ends of at least one of said powder and ball cylinders is tapered inwardly.

20. The cartridge of claim 9 in which the inner bores of each of said powder and ball cylinders are sized the same as each other and the same as the longitudinal bore of the rifle.

21. The cartridge of claim 9 in which the first end of the alignment cylinder is configured to receive one or more adapter rings in order to be made to fit a rifle barrel of a smaller diameter.

* * * * *